US006225604B1

(12) United States Patent
Whipple, Jr.

(10) Patent No.: US 6,225,604 B1
(45) Date of Patent: May 1, 2001

(54) BLOWER ASSEMBLY FOR SELF-CLEANING CONVECTION OVEN

(75) Inventor: Robert Z. Whipple, Jr., Loudon, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/650,415

(22) Filed: Aug. 29, 2000

(51) Int. Cl.[7] ..... A21B 1/00; A21B 1/22; A21B 11/00

(52) U.S. Cl. ..... 219/400; 126/21 A

(58) Field of Search ..... 219/400, 681; 126/21 A; 425/430

(56) References Cited

U.S. PATENT DOCUMENTS

| | | | | |
|---|---|---|---|---|
| 3,656,469 | | 4/1972 | Jung et al. . | |
| 3,698,377 | * | 10/1972 | Smith | 126/21 A |
| 3,938,928 | * | 2/1976 | Andrews | 425/430 |
| 4,071,739 | * | 1/1978 | Jenn et al. | 219/400 |
| 4,108,139 | * | 8/1978 | Gilliom et al. | 126/21 A |
| 4,332,992 | * | 6/1982 | Larsen et al. | 219/681 |
| 4,409,453 | * | 10/1983 | Smith | 219/681 |
| 4,829,158 | * | 5/1989 | Burnham | 219/400 |
| 4,912,927 | | 4/1990 | Billington . | |
| 5,205,273 | * | 4/1993 | Sparks et al. | 126/21 A |
| 5,222,474 | * | 6/1993 | Yencha | 126/21 A |
| 5,468,935 | * | 11/1995 | Wang | 219/400 |
| 5,533,444 | | 7/1996 | Parks . | |
| 5,601,070 | * | 2/1997 | Hotard et al. | 126/21 A |
| 5,801,362 | * | 9/1998 | Pearlman et al. | 219/400 |
| 5,928,541 | * | 7/1999 | Tsukamoto et al. | 219/400 |

FOREIGN PATENT DOCUMENTS

| | | |
|---|---|---|
| 4-87547 | 3/1992 | (JP) . |
| 8-196058 | 7/1996 | (JP) . |

* cited by examiner

*Primary Examiner*—Teresa Walberg
*Assistant Examiner*—Leonid Fastovsky
(74) *Attorney, Agent, or Firm*—Diederiks & Whitelaw PLC

(57) ABSTRACT

A blower assembly for a cooking appliance having an oven cavity adapted to operate in at least cleaning and convection cooking modes includes a blower element mounted for rotation though a shaft member supported by at least one bearing unit. The shaft member is constituted by a tubular section which is secured to the blower element and a solid shaft section which extends within the tubular section. The solid shaft section is formed from a material having a higher thermal conductivity than the tubular section and concentrically arranged relative to the bearing unit. With this arrangement, the shaft section acts as a heat sink for directing heat, to which the blower element is subjected, away from both the tubular section and the bearing unit. The shaft section preferably terminates within the tubular section at a distance spaced from the blower element such that a thermal air gap is defined within the tubular section.

20 Claims, 2 Drawing Sheets

FIG, 1

BLOWER ASSEMBLY FOR SELF-CLEANING CONVECTION OVEN

BACKGROUND OF THE INVENTION

1. Field of the Invention

The present invention pertains to the art of cooking appliances and, more particularly, to a drive and support structure for a blower used in a self-cleaning convection oven.

2. Discussion of the Prior Art

Tremendous advancements have been made in the art of cooking appliances in the relatively recent past. For instance, it was not many years ago that conduction and/or radiant heat sources were almost exclusively relied upon in connection with household ranges and wall ovens. However, more recent trends are to further take advantage of convection as an additional heating system. That is, a flow of air can be circulated through an oven cavity, while being subjected to one or more heat sources, with the heated air being distributed into the oven cavity to develop substantially uniform cooking of a food product.

As with more conventional oven cooking arrangements, it is desirable to provide a self-cleaning function for the oven cavity regardless of the particular type of heating source(s) used with the convection oven. However, with such an arrangement, the air handling system can be subjected to extreme temperatures. Various components of the air handling system, such as a bearing arrangement utilized to rotatably support a blower element of the system, can be adversely affected when subjected to such high temperatures.

Based on the above, there exists a need in the art for a blower assembly used in a cooking appliance, including an oven cavity adapted to operate in at least cleaning and convection cooking modes, wherein sensitive components of the blower assembly are isolated from extreme temperatures during operation of the cooking appliance. In addition, there is a need for a blower assembly for a convection cooking appliance which is easy to assemble, reliable and cost effective, while being designed to establish a temperature gradient between its various components which assures that more temperature sensitive components are protected.

SUMMARY OF THE INVENTION

The present invention is directed to the drive and support structure for a high speed blower assembly used in a self-cleaning, convection oven. In such an environment, a blower element of the assembly can be subjected to extreme temperatures, including those reaching and exceeding 900° F. (approx. 480° C.). In accordance with the invention, the blower element is secured to the first end of a tubular section of a drive shaft which, in turn, is rotatably supported by one or more bearing units. In the most preferred form of the invention, an opposing end of the tube has secured thereto a sheeve used for rotating the blower element and drive shaft through a motor and pulley arrangement.

In accordance with the invention, it is desired to reduce the conduction of heat from the blower element, through the tube and into at least the bearings. For this purpose, the tube has fitted therein a rod which is formed of a material having a relatively high thermal conductivity as compared to the tube. In the most preferred embodiment of the invention, the tube is formed of stainless steel and an aluminum rod is pressed-fit into the tube. Most preferably, the rod extends from the second end portion of the tube, concentrically past the bearings, but terminates short of the blower element such that a thermal air break zone is defined, within the tube, between the aluminum rod and the blower element.

With this arrangement, given the relatively low coefficient of thermal conductivity of the tube, as well as its reduced cross section, the temperature gradient between the blower element and the tube is increased. The aluminum rod acts as a heat sink which functions to further reduce the temperature to which the bearings are subjected. Therefore, due to the gradient created and the function of the heat sink, the operational temperatures experienced by the shaft bearings are substantially reduced.

Additional objects, features and advantages of the present invention will become more readily apparent from the following detailed description of a preferred embodiment thereof when taken in conjunction with the drawings wherein like reference numerals refer to corresponding parts in the several view.

DETAILED DESCRIPTION OF THE PREFERRED EMBODIMENT

Figure 1:
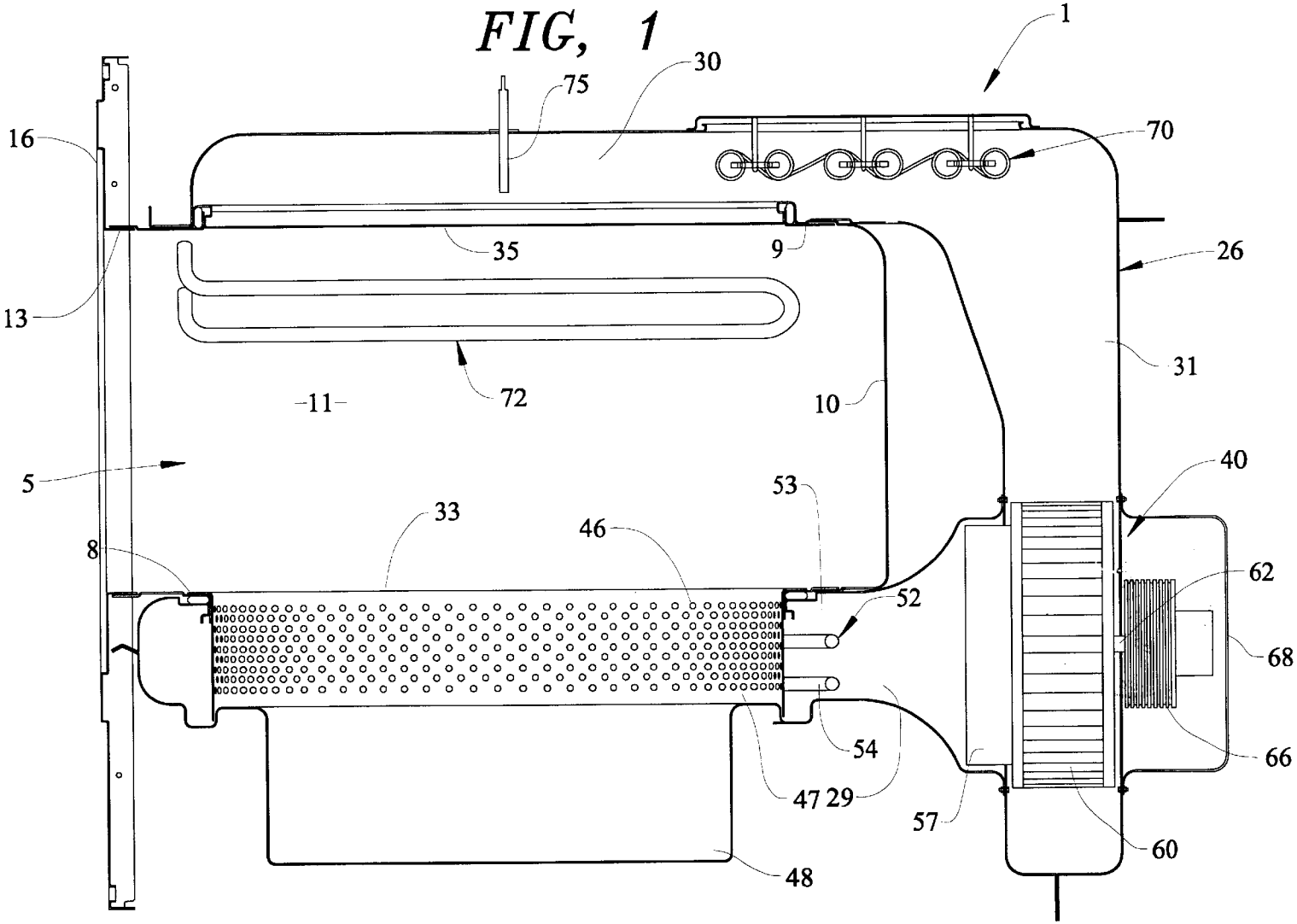
FIG. 1 is a schematic side view of a convection oven incorporating a blower assembly constructed in accordance with the present invention.

With initial reference to FIG. 1, a cooking appliance 1 is schematically shown in the form of a wall oven. Appliance 1 includes an oven cavity 5 generally defined by a bottom wall 8, a top wall 9, a rear wall 10 and a pair of side walls, one of which is indicated at 11. Oven cavity 5 also has associated therewith an access opening 13 for food items to be placed into or withdrawn from cavity 5. About access opening 13 is provided a frontal plate 16. In a manner known in the art, frontal plate 16 is adapted to be mounted against a substantially vertical wall such as in the kitchen of a residential home, and would have a door (not shown) pivotally attached thereto for selectively sealing off access opening 13.

Extending generally along bottom, top and rear walls 8–10 of cavity 5 is an air channel assembly 26 defined by ducting that leads into and out of cavity 5. More specifically, air channel assembly 26 includes a lower air return section 29, an upper air delivery section 30 and a rear air transfer section 31. Lower air return section 29 is open into cavity 5 through a substantially central return air outlet 33 formed in bottom 8. In the most preferred form of the invention, return air outlet 33 is constituted by a generally circular insert provided with various spaced holes (not shown). In a similar manner, upper air delivery section 30 includes a discharge or delivery inlet 35 formed in top wall 9. Although not shown in detail, inlet 35 is also preferably constituted by a generally circular-shaped insert which is attached to the remainder of upper air delivery section 30 and which is provided with a plurality of holes. As will become more fully evident below, the particular construction of cooking appliance 1 can significantly vary in accordance with the present invention. More specifically, it is only important in accordance with the present invention that cooking appliance 1 include an air channel assembly, such as that discussed above with reference to assembly 26, as well as a blower assembly, such as that generally indicated at 40, for use in generating a circulating flow of air through oven cavity 5. Although not considered a part of the present invention, a preferred construction for oven cavity 5 and air channel assembly 26 can be found in U.S. patent application entitled "OVEN CAVITY CONSTRUCTION" filed on even date herewith which is hereby incorporated by reference.

In the preferred embodiment shown, cooking appliance 1 constitutes an electric appliance and, more specifically, a combination convection, microwave and radiant cooking device. As shown in this Figure, cooking appliance 1 is provided with an annular filter basket 46, having a multitude of circumferentially spaced holes 47, which is positioned within lower air return section 29 and through which the air flowing from cavity 5 through return air outlet 33 is directed. Arranged below filter basket 46 is a microwave generator unit 48 incorporating a magnetron (not specifically shown). Encircling at least a portion of filter basket 46 is a first electric heating unit 52. Heating unit 52 is shown as constituted by a sheathed electric resistance heating element having upper and lower interconnected legs 53 and 54. First electric heating unit 52 is preferably provided to heat return air flowing from oven cavity 5, through outlet 33 and filter basket 56 prior to the air reaching a catalyst indicated at 57. In a manner known in the art, catalyst 57 functions to eliminate smoke and the like from the air stream. As shown, catalyst 57 extends partially within a rotatable blower element 60 which forms part of blower assembly 40. Although blower element 60 can take various forms while performing the desired air flow generating function, blower element 60 preferably constitutes a centrifugal unit arranged at the conjure of lower air return section 29 and rear air transfer section 31. In general, blower element 60 is secured to a rotatable shaft member 62. Shaft member 62 also has attached thereto, for non-relative rotation, a sheeve 66 which is adapted to receive a belt (not shown) for use in rotating blower element 60 through shaft member 62 in combination with an electric motor (also not shown). As illustrated, sheeve 66 is preferably arranged within a housing extension 68 which projects from rear air transfer section 31.

Preferably mounted in upper air delivery section 30 adjacent rear transfer section 31 is a second electric heating element arrangement 70 that is preferably constituted by a bank of heating coils. Although not pertinent to the present invention, second heating unit 70 can be defined by a single electric coil that runs back and forth across upper air delivery section 30 or multiple, separately controllable coil elements. In any event, second heating unit 70 functions to further heat the air flowing through channel assembly 26 prior to the air reaching discharge inlet 35. Also shown in this Figure is a third electric heating unit 72 which, in a manner similar to first electric heating unit 52, is preferably constituted by a sheathed, resistance-type heating element. Third electric heating unit 72 preferably extends adjacent top wall 9 and constitutes an additional heat source for cavity 5 of cooking appliance 1. The particular manner in which first, second and third electric heating units 52, 70 and 72 are utilized during operation of cooking appliance 1 for both cooking and cleaning modes of operation are not considered to constitute part of the present invention. Instead, these details can be found in U.S. patent applications entitled "HEATING SYSTEM FOR A COOKING APPLIANCE" and "SELF-CLEANING SYSTEM FOR A COOKING APPLIANCE", both of which are filed on even date herewith and incorporated by reference. In general, each of blower assembly 40, microwave generator 48 and first, second and third electric heating units 52, 70 and 72 are linked to an appliance control (not shown) and regulated based on established operator settings, as well as signals received from a temperature sensor 75.

The present invention is particularly directed to the structure of blower assembly 40. Therefore, as indicated above, cooking appliance 1 can take various forms without departing from the invention and the particular construction described above should only be considered exemplary and not restrictive. It is only important that blower assembly 40 is utilized in connection with a cooking appliance that can operate in a cleaning mode wherein rather high temperatures, generally in the order of 900° F. (approx. 480° C.) are generated within oven cavity 5 for pyrolytic cleaning purposes such that blower element 60 is subjected to an air stream having a temperature of this general magnitude. Given that such temperatures can have detrimental effects on the useful life of various components of such an air handling system, blower assembly 40 is configured in manner which effectively protects vulnerable components thereof from these high temperatures as will be detailed more fully below.

Figure 2:
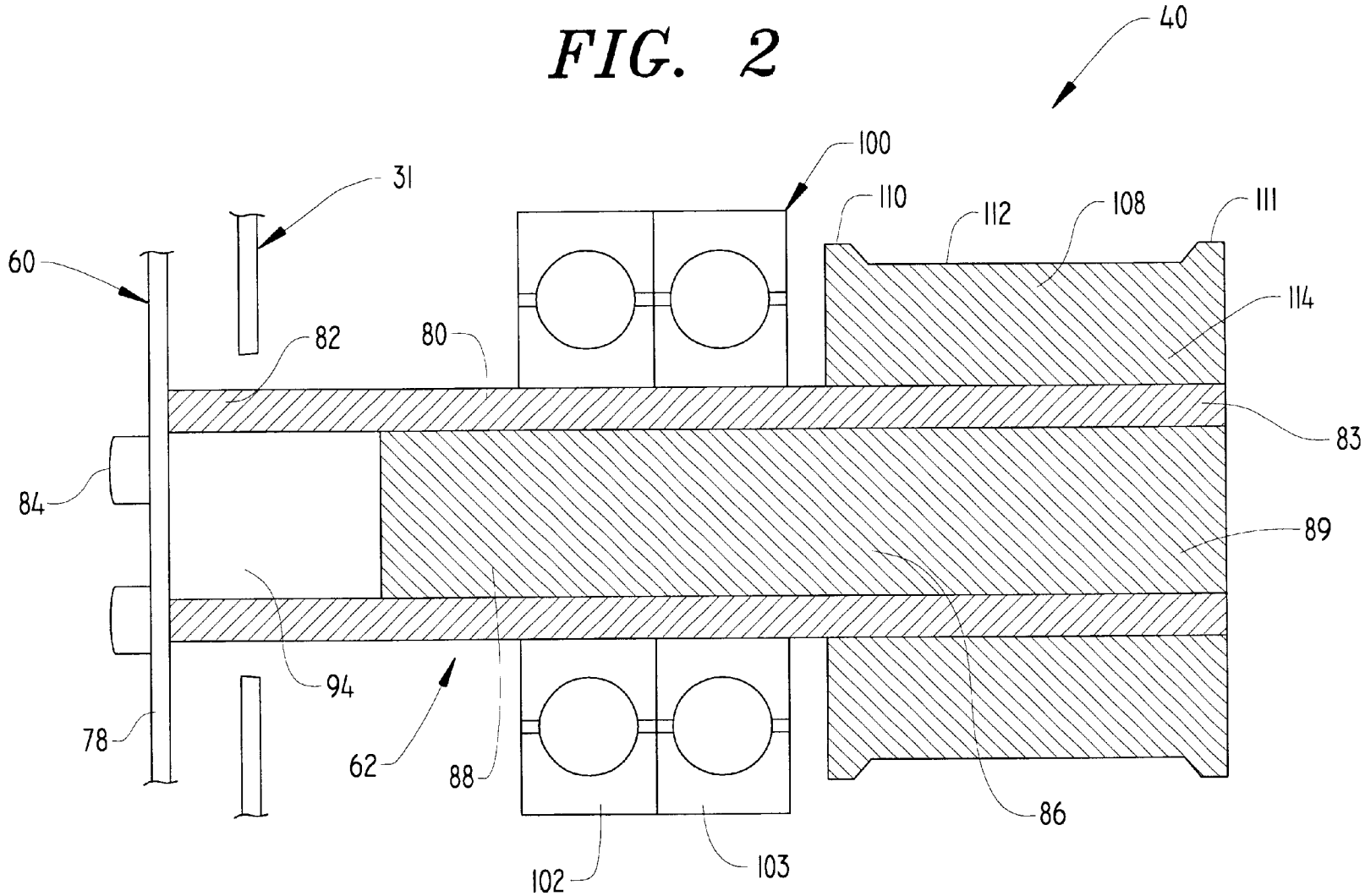
FIG. 2 is an enlarged, schematic and partial sectional side view of the blower assembly incorporated in the convection oven of FIG. 1.

FIG. 2 illustrates the preferred construction of blower assembly 40 in accordance with the present invention. Therefore, this Figure shows a rear panel portion 78 of blower element 60 to which is attached a shaft member 62. More specifically, shaft member 62 includes a first, tubular section 80 having a first end portion 82 and a second end portion 83. As shown, first end portion 82 is secured to blower element 60, such as through a crimping operation with one of the resulting crimps being generally indicated at 84. Shaft member 62 also includes a second, solid shaft or rod section 86 having a first end 88 and a second end 89. As shown, second section 86 of shaft member 62 is positioned within tubular section 80, with second end 89 being arranged generally concentric with second end portion 83 and with first end 88 terminating short of first end portion 82 such that a thermal air break zone or gap 94 is defined within tubular section 80, between first end 88 and rear panel portion 78 of blower element 60.

In the most preferred form of the invention, first, tubular section 80 is formed from stainless steel, while second, solid section 86 is formed from aluminum. Regardless of the particular materials utilized, second section 86 is configured to have a higher thermal conductivity than tubular section 80 for the reasons which will become more fully evident below.

In the embodiment shown, blower element 60 is rotatably mounted through shaft member 62 and a bearing assembly 100 defined by a dual bearing including a first bearing unit 102 and a second bearing unit 103. As shown, shaft section 86 preferably extends within tubular section 80 concentric with bearing assembly 100 and beyond bearing assembly 100 towards blower element 60. Sheeve 66 is shown to include an outer radial portion 108, which is provided with spaced, upstanding annular lips 110 and 111 between which is defined a belt receiving zone 112. The actual configuration of belt receiving zone 112 can vary in accordance with the present invention to be splined, V-shaped, smooth or the like as is widely known in the art. Sheeve 66, which is also preferably casted of aluminum, further includes an inner radial portion 114 shrink-fit onto tubular section 80. As should be readily evident, sheeve 66 is adapted to be rotated through the use of a pulley and motor arrangement (not shown) for use in rotating shaft member 62 about a central, axially extending axis defined by shaft member 62, with shaft member 62 being supported for rotation by bearing assembly 100 in order to drive blower element 60. In such a drive arrangement, it should be recognized that sheeve 66 could be drivingly connected to shaft member 62 in various ways, including a spline connection. In addition, shaft member 62 could be directly driven by a motor, through a gearing system, a chain drive arrangement or the like. In addition, sheeve 66 could be formed of various other materials without departing from the invention. Sheeve 66 could also be formed of nylon, preferably with a powdered metal core which is press-fit onto tubular section 80. In any event, various material and drive arrangements are possible in accordance with the invention.

Although the particular components and construction of blower assembly 40 can vary in accordance with the present invention, it is important to note that blower element 60 can be subjected to rather high temperatures, particularly when cooking appliance 1 is utilized in a self-cleaning mode. For instance, in such a mode of operation, oven cavity 5 can reach temperatures in the order of 930°–950° F. (approx. 500°–510° C.), with the air flowing in air channel assembly 26 being subjected to this temperature which, in turn, develops an ambient temperature in the order of approximately 900° F. (approx. 480° C.) at blower element 60. The invention is particularly concerned with isolating bearing assembly 100, as well as other components of blower assembly 40, from these extreme temperatures. In accordance with a first aspect of the invention, the use of tubular section 80 provides a reduced cross section at the connection with blower element 60 versus if a solid drive shaft were utilized. Therefore, the area in which conduction heat transfer can occur is substantially reduced. Second, solid shaft section 86, by virtue of its high thermal conductivity, tends to function as a heat sink to further direct heat away from tubular section 80. Furthermore, the inclusion of the thermal air gap 94 also operates as an insulator. With this arrangement, it has been found that the temperature of tubular section 80 at bearing assembly 100 will typically only reach in the order of 220°–250° F. (approx. 100°–120° C.) versus the 900° F. (approx. 480° C.) experienced by blower element 60. Therefore, bearing assembly 100 is subjected to these much lower temperatures which can be readily handled without degrading the operation or useful life of the bearing assembly 100. Based on tests conducted in comparing the blower assembly 40 with an arrangement wherein a single solid shaft is utilized for driving the blower element, the temperatures at which bearing assembly 100 is subjected in accordance with the present invention is significantly lower, generally in the order of 70°–100° F. (approx. 20°–40° C.).

Based on the above, it should be readily apparent that the particular construction of blower assembly 40 can enhance its overall useful life, while still representing a relatively simply constructed and cost effective system. However, although described with respect to a preferred embodiment of the invention, it should be readily understood that various changes and/or modifications can be made to the invention with departing from the spirit thereof. Instead, the invention is only intended to be limited by the scope of the following claims.

What is claimed is:

1. In a cooking appliance including an oven cavity adapted to operate in at least cleaning and convection cooking modes, a blower assembly comprising:

at least one bearing unit;

a tube supported by the at least one bearing unit for rotation about an axis; and a blower element for developing a flow of air for the oven cavity upon rotation of the blower element, said blower element being drivingly connected to the tube, with the at least one bearing unit rotatably supporting the blower element through the tube.

2. The blower assembly according to claim 1, further comprising: a heat sink for directing heat, to which the blower element is subjected, away from the at least one bearing unit.

3. The blower assembly according to claim 2, wherein said heat sink is constituted by a shaft concentrically arranged within said tube.

4. The blower assembly according to claim 3, wherein said tube has an associated length, with the shaft being shorter than said length.

5. The blower assembly according to claim 4, wherein at least a portion of the shaft is concentric with the at least one bearing unit.

6. The blower assembly according to claim 4, further comprising: a thermal air gap, defined within the tube, between the blower element and the shaft.

7. The blower assembly according to claim 3, wherein the shaft is formed from aluminum.

8. The blower assembly according to claim 7, wherein the tube is formed from stainless steel.

9. The blower assembly according to claim 2, further comprising: a mechanism for driving the tube for rotation about said axis.

10. The blower assembly according to claim 9, wherein said driving mechanism includes a sheeve non-rotatably secured to the tube.

11. The blower assembly according to claim 10, wherein said sheeve is shrink-fit onto the tube.

12. The blower assembly according to claim 10, wherein the sheeve is formed from aluminum.

13. The blower assembly according to claim 10, wherein the tube is rotatably supported solely through the at least one bearing unit which is positioned entirely between the blower element and the sheeve.

14. In a cooking appliance including an oven cavity adapted to operate in at least cleaning and convection cooking modes, a blower assembly comprising:

a rotatable blower element arranged in fluid communication with the oven cavity for developing a flow of air for the oven cavity upon rotation of the blower element; and a shaft member for rotatably supporting the blower element, said shaft member being formed from first and second concentrically arranged shaft sections, with the second shaft section being formed of a material having a higher thermal conductivity than the first shaft section.

15. The blower assembly according to claim 14, wherein the second shaft section is formed from aluminum.

16. The blower assembly according to claim 14, wherein the first shaft section is constituted by a tube within which the second shaft section extends, said tube having an associated length and the second shaft section being shorter than said length.

17. The blower assembly according to claim 16, further comprising: a thermal air gap, defined within the tube, between the blower element and the shaft section.

18. The blower assembly according to claim 17, further comprising: at least one bearing unit rotatably supporting the shaft member for rotation about an axis.

19. The blower assembly according to claim 18, wherein the second shaft section is concentric with the at least one bearing unit.

20. The blower assembly according to claim 18, further comprising: a sheeve fixed to the first shaft section for use in rotatably driving the blower element, said sheeve being arranged further from the blower element than the at least one bearing unit.

* * * * *